US005278618A

United States Patent [19]

Mitani et al.

[11] Patent Number: 5,278,618

[45] Date of Patent: Jan. 11, 1994

[54] THERMAL FIXING DEVICE INCLUDING A NON-ADHESIVE RESIN COATED METAL BELT AND PTC THERMISTOR HEATER

[75] Inventors: Masao Mitani, Ibaraki; Susumu Takahashi; Naoki Oda, both of Kanagawa, Japan

[73] Assignee: Hitachi Koki Co., Ltd., Tokyo, Japan

[21] Appl. No.: 850,897

[22] Filed: Mar. 13, 1992

[30] Foreign Application Priority Data

Mar. 14, 1991 [JP] Japan ..... 3-49392

[51] Int. Cl.[5] ..... G03G 15/20

[52] U.S. Cl. ..... 355/285; 219/216; 355/282

[58] Field of Search ..... 355/282, 284, 285, 286, 355/287, 288, 289, 290, 200, 210, 229; 219/216; 118/60

[56] References Cited

U.S. PATENT DOCUMENTS

| | | | |
|---|---|---|---|
| 3,578,797 | 5/1971 | Hodges et al. . | |
| 3,788,739 | 1/1974 | Coriale | 355/210 |
| 3,811,828 | 5/1974 | Ohta et al. . | |
| 3,888,577 | 6/1975 | Meyer | 355/200 |
| 3,948,215 | 4/1976 | Namiki | 118/60 X |
| 4,132,882 | 1/1979 | Endo et al. | 219/216 |
| 4,724,303 | 2/1988 | Martin et al. | 219/216 |
| 4,912,514 | 3/1990 | Mizutani | 219/216 X |
| 4,954,845 | 9/1990 | Yano et al. | 355/290 |
| 5,051,784 | 9/1991 | Yamamoto et al. | 355/285 |
| 5,053,829 | 10/1991 | Field et al. | 355/290 |
| 5,084,738 | 1/1992 | Ishikawa | 355/285 |
| 5,091,752 | 2/1992 | Okada | 355/285 |
| 5,099,288 | 3/1992 | Britto et al. | 355/290 |
| 5,101,236 | 3/1992 | Nelson | 355/229 |
| 5,115,278 | 5/1992 | Maruta et al. | 355/285 |
| 5,118,920 | 6/1992 | Tanabe et al. | 219/216 |
| 5,119,143 | 6/1992 | Shimura | 355/289 |

FOREIGN PATENT DOCUMENTS

| | | | |
|---|---|---|---|
| 57-116961 | 1/1956 | Japan . | |
| 49-70633 | 7/1974 | Japan . | |
| 53-17061 | 6/1978 | Japan . | |
| 58-190659 | 12/1983 | Japan . | |
| 63-68665 | 5/1988 | Japan . | |
| 63-313182 | 12/1988 | Japan . | |
| 1-144084 | 6/1989 | Japan . | |
| 1-263677 | 10/1989 | Japan . | |
| 1-263679 | 10/1989 | Japan . | |
| 1-263680 | 10/1989 | Japan . | |
| 0157878 | 6/1990 | Japan | 355/290 |
| 0157882 | 6/1990 | Japan | 355/290 |
| 2-158782 | 6/1990 | Japan . | |
| 0024577 | 2/1991 | Japan | 355/282 |

*Primary Examiner*—A. T. Grimley
*Assistant Examiner*—Sandra L. Brase
*Attorney, Agent, or Firm*—Sughrue, Mion, Zinn, Macpeak & Seas

[57] ABSTRACT

In a thermal fixing device, a roller having a heat generating element includes a heating and cooling unit which is made up of a cooling device which serves also as a support, and a heat generating device with a PTC thermistor heater element as a heat source so that an endless metal belt which is turned while being in contact with the heating and cooling is heated on the transfer sheet inlet side and cooled on the transfer sheet outlet side. Thus, the toner on a transfer sheet which is not fixed yet is heated to higher than the melting point on the transfer sheet inlet side so as to be molten and permeated in the transfer sheet, and cooled on the transfer sheet outlet side, and then separated from the metal belt. The surface of the metal belt is covered with lubricative resin, to prevent the occurrence of low temperature offset or high temperate offset, with a result that the fixing operation is stable at all times.

7 Claims, 4 Drawing Sheets

THERMAL FIXING DEVICE INCLUDING A NON-ADHESIVE RESIN COATED METAL BELT AND PTC THERMISTOR HEATER

BACKGROUND OF THE INVENTION

This invention relates to a thermal fixing device in an image forming apparatus.

A conventional fixing device in an image forming apparatus utilizing an electrophotographic process is a thermal fixing device which is made up of a pair of rollers which are rotated while being pushed against each other. In order to improve the thermal efficiency and the image fixing characteristic of the device, at least one of the rollers has a heat generating unit. Temperature detecting means such as a thermistor element is held in contact with the surface of the roller having the heat generating unit (hereinafter referred to as a "heat roller"). The temperature detecting means cooperates with a temperature controlling power source to set the surface temperature of the heat roller to an image fixing temperature. A transfer sheet on which a toner image has been transferred is passed through the rollers thus heated, so that the toner image is fixed on the transfer sheet by heat and pressure.

The heat roller is generally formed as follows: A sheathed heater or halogen lamp heater is fixedly inserted in a metal roller. However, the heat roller thus formed is disadvantageous in the following points: A period of time required for increasing the temperature of the roller to an image fixing temperature, about 130°, is relatively long, e.g., more than one minute. In addition, the heating element is high in temperature 250° to 300° C. or higher. Accordingly, the surface temperate of the heat roller is variable in a wide range, so that an unwanted offset phenomenon is liable to occur. Moreover, for the same reason, the power consumption is large, e.g. more than 800 watts.

In order to eliminate the above-described difficulties, the following thermal fixing system has been proposed in the art (cf. Japanese Patent Application Publication No. 17061/1978, and U.S. Pat. No. 3,811,828) stationary heat generating unit is brought into close contact with a transfer sheet, on which a toner image is formed so as to be fixed, through a thin endless film of heat-resisting resin which is moved in synchronization with the transfer sheet. A concrete example of the system has been disclosed in a Japanese Electrophotographic Society, June 1990. More specifically, the concrete example of the system has been disclosed as a SURF system by Canon (Co., Ltd.) In the system, when the image fixing speed is 6 cpm (copies per minute)/A4, and a period of time required for obtaining an image fixing temperature (hereinafter referred to as "a temperature rise time", when applicable) is five seconds or less, the stationary heat generating unit is 180° to 190° C., and the necessary heating electric power is 400 to 450 watts. These numerical values indicate that the SURF system is novel in performance.

Listed below, substantially in the order of introduction in the art, are conventional methods concerning the SURF system:

(1) First method: A stationary heat generating element at a predetermined temperature is pushed against a fixing sheet through a thin endless belt of resin which is moved at the same speed as the fixing sheet, so as to subject the toner on the fixing sheet to fixing. The method aims to reduce the period of time required for starting the fixing operation, and to decrease the power consumption. (U.S. Pat. 3,811,828)

(2) Second method: A thermally conductive endless belt is laid over a heating roller and a guide roller. A fixing sheet is loaded on the belt on the side of the heating roller. The fixing sheet thus loaded is conveyed while being pushed against the belt, and is then unloaded from the belt on the side of the guide roller. During this operation, the toner on the fixing sheet which has not been fixed yet is molten at the vicinity of the heating roller, and it is cooled while the fixing sheet is being conveyed to the vicinity of the guide roller. The method aims to reduce the amount of offset. (U.S. Pat. No. 3,578,797)

(3) Third method: In the second method, the thermally conductive endless belt is made of "Teflon" or metal. (Japanese Patent Application (OPI) No. 70633/1974 (the term "OPI" as used herein means an "unexamined published application")

(4) Fourth method: An endless belt of metal is laid over two rollers. The endless belt is heated with a lamp, or by the direct application of electric current or by electromagnetic induction. From outside of the endless belt, a fixing sheet with toner is inserted between one of the two rollers and a pressure roller abutted against it, so as to fix the toner on the fixing sheet. (Japanese Utility Patent Application (OPI) No's 116961/1982, 190659/1983 and 68665/1988, and Japanese Patent Application (OPI) No. 144084/1989)

(5) Fifth method: A stationary heat generating element which performs a heating operation and a cooling operation repeatedly in a pulse mode is pushed against a fixing sheet through an endless belt of resin which is moved at the same speed as the fixing sheet, to melt and solidify the toner on the fixing sheet which has not yet been fixed. (Japanese Patent Application (OPI) No's 313182/1988, 263677/1989, and 263680/1989)

(6) Sixth method: A stationary heating element which is formed integral with a PTC heat generating element and is maintained at a predetermined temperature is pushed against a fixing sheet, on which toner is provided, through an endless belt of resin which is moved at the same speed as the fixing sheet, to fix the toner on the fixing sheet. (Japanese Patent Application (OPI) No's 263679/1989 and 158782/1990)

Of the above-described methods, the first method is a fundamental patent on a belt method. This idea has been put in practical use as the SURF system by Canon (Co., Ltd.) for the first time.

The second method can be considered as a fundamental patent on a heating and cooling method in which an amount of offset can be decreased most readily. However, it has not been practiced yet, apparently because it takes a relatively long period of time to cool the toner and the heated fixing sheet's surface down to a temperature at which the toner viscosity is sufficiently large, with results that the fixing unit is unavoidably bulky and the fixing speed is low.

The third method is similar to the second method. In this method, the belt may be a mirror-finished thin endless belt of stainless steel as well as the endless belt of "Teflon". The method, however, has not been practiced yet.

The fourth method is one of conventional methods of heating a metal belt; however, it is difficult to practice. The object of the method is not clear and it has not apparently been practiced yet.

In the fifth method, the toner on the fixing sheet which is pushed through the resin belt by the stationary heat generating element, is heated by application of pulse current for a short period of time so that it is molten. Thereafter, the toner thus molten is cooled for a period of time several times longer than the period of time required for application of the pulse current so that the molten toner is increased in viscosity. The fixing sheet is conveyed at a predetermined rate; that is, it is conveyed a distance corresponding to the width of the stationary heat generating element each cycle in which the application of the pulse current and the cooling of the toner are carried out. In practice, it is necessary that the distance of movement of the fixing sheet is smaller than the width of the stationary heat generating element. It is apparent that the endless belt of resin should be about 30 μm or more, although its concrete example (a fixing unit of SURF system) has not been referred to. Hence, in order to heat and cool the toner through the endless belt of resin which is thick as described above and accordingly low in thermal conduction, it is necessary to significantly decrease the fixing speed. Thus, the method is not practical. This is the reason why Canon (Co., Ltd.) has employed the first method instead of the fifth method as the SURF system.

The sixth method relates to the heating source in the stationary heat generating element in the first method. The invention relates to a method of providing a heating zone and a cooling zone; however, it can be considered that the sixth method is similar to the second method. The sixth method has not been practiced yet.

In the first method, as proven by the SURF system, the waiting time, which elapses until the start of the fixing operation, can be greatly reduced, and the power consumption can be greatly decreased. This excellent invention was put into practical use twenty years ago, because it was then that it became possible to manufacture a thin endless belt using polyimide high rigidity and high in heat resistance. In order to prevent the occurrence of offset, it is essential to form a film of release agent such as PTFE on the surface of the polyimide belt. The belt can be used until the film thus formed peels off. More specifically, the belt can be used for printing about 50,000 sheets of paper of A4 size. This is less than half (½) of the average service life of the conventional heat roller type fixing unit.

On the other hand, when an endless belt is driven, in general, it moves from side to side. In order to control such side to side movement the belt, its thickness must be reduced, although a reduction of the thickness of the belt is limited to some extent. In the case of the SURF system, the thickness of the belt is set to about 30 μm including the PTFE layer. This thickness impedes the transmission of heat from the stationary heat generating element, and accordingly it is necessary to set the temperature of the stationary heat generating element to a value much higher than the toner fixing temperature.

The capacity of heating through the PTFE/polyimide double layer belt of this thickness depends on the heat resistance of polyimide material, and it is estimated that a fixing capacity of 6 to 10 cpm (copies per minute)-/A4 is the limitations in the SURF system. The low thermal conduction of the double layer belt makes it impossible to put the second method to practical use, and, in practicing the fifth method, causes the fixing speed to be set to a value which is too slow to be practical.

As was described above, the SURF system is a novel system which is advantageous in that the temperature-rise time is short, and the power consumption is small. The system has many other excellent advantages. However, the SURF system still suffers from problems in that the thermal fixing device has a relatively short service life because of the short service life of the thin endless polyimide film (50,000 sheets of size A4 paper—the application of the SURF system is limited to a low speed thermal fixing device), yet the thermal fixing device is intricate in construction and accordingly high in manufacturing cost. In addition, the temperature of the stationary heat generating unit is much higher than required for the fixing operation. Thus, it is necessary to decrease the temperature of the stationary heat generating unit and to further decrease the electric power required for heating it.

SUMMARY OF THE INVENTION

Accordingly, an object of this invention is to provide a thermal fixing device in which the excellent characteristics of the SURF system is fully utilized, its service life is increased, the stationary heat generating unit is decreased in temperature, and the heating electric power is reduced, and which is applicable to all electrophotographing apparatuses ranging from high speed ones to low speed ones.

The foregoing object and other objects of the invention have been achieved by the provision of:

(1) A thermal fixing device having a pair of rollers at least one of which has a heat generating member in which the rollers are turned while being pushed against each other, and an image support with a toner image which is not fixed yet is passed through the rollers so that the toner image is fixed by thermal melting; in which, according to a first aspect of the invention, the roller having the heat generating member, comprises: an elongated heat generating unit; an annular metal film which is turned while being held in contact with the heat generating unit, the outer surface of the annular metal film which is brought into contact with the image support being coated with lubricative resin; a drive roller for turning the metal film while giving tension to the metal film, (2) A thermal fixing device having a pair of rollers at least one of which has a heat generating member in which the rollers are turned while being pushed against each other, and an image support with a toner image which is not fixed yet is passed through the rollers so that the toner image is fixed by thermal melting; in which, according to a second aspect of the invention, the roller having the heat generating member comprises: a heat generating unit; a cooling unit; an annular metal film which is turned while being in contact with said heat generating unit and said cooling unit, said annular metal film having a layer of lubricative resin on the outer surface thereof which is brought into contact with said image support; and a drive roller for turning said annular metal film while giving tension to said annular metal film, or (3) A thermal fixing device having a pair of rollers at least one of which has a heat generating member in which the rollers are turned while being pushed against each other, and an image support with a toner image which is not fixed yet is passed through the rollers so that the toner image is fixed by thermal melting; in which, according to a third aspect of the invention, the roller having the heat generating member comprises: a heating and cooling unit including a cooling device which serves also as a support, and a heat generating device with a PTC thermistor heater element as a heat source; a thin endless metal belt which is turned while being in contact with the heating and cooling unit, the outer surface of the metal belt which is brought into contact with the image support being coated with lubricative resin; and a drive roller for turning the metal belt while giving tension to the metal belt.

The nature, utility and principle of the invention will be more clearly understood from the following detailed description and the appended claims when read in conjunction with the accompanying drawings.

DETAILED DESCRIPTION OF THE PREFERRED EMBODIMENTS

Figure 1:
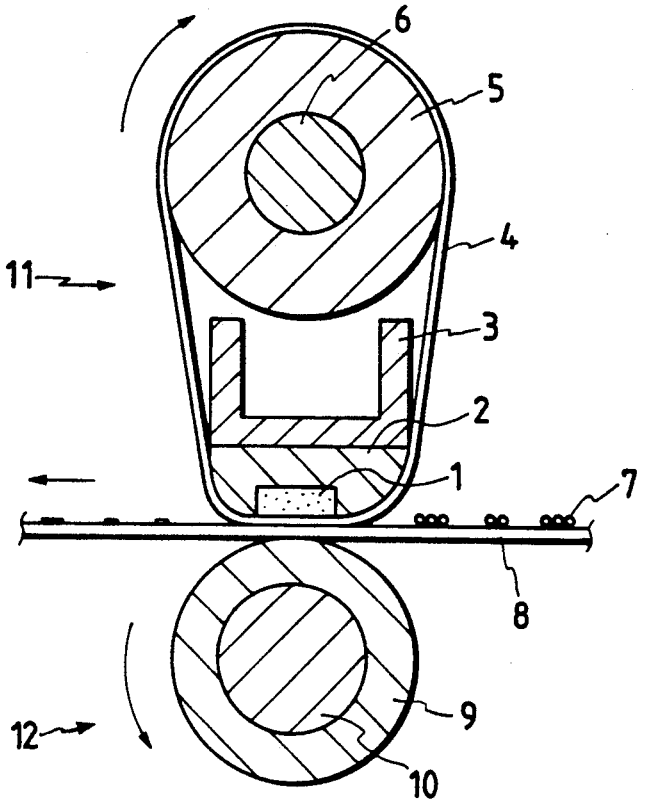
FIG. 1 is a sectional diagram showing an example of a thermal fixing device according to this invention.

A thermal fixing device according to this invention includes an annular metal film which is formed, for instance, by electrocasting. The metal film may be formed by other methods such as a welding method and a deep drawing method. However, the electrocasting method is most suitable for manufacture of the metal film. That is, when the electrocasting method is employed, the given specification is satisfied, and the metal film can be produced on a large scale. In the invention, the metal film is formed by electrocasting as follows: A thin oxide film is formed on the surface of a base mold serving as an electrode, and then plated. The resultant electrocasting is removed from the mold after being heated and cooled. The base mold is used again. The electrocasting thus formed is seamless. That is, it is most suitable as an endless film in the thermal fixing device of the invention. Any metal material may be used for forming the annular metal film if it is suitable for the latter. However, it is preferable to use pure nickel (Ni), Ni—Co alloy, copper, or copper alloy which is stable against the plating solution.

A typical example of lubricative resin is fluoro-resin. The force of adhesion of fluoro-resin to any material is low. Hence, in the case where a polyimide film surface-treated with fluoro-resin is employed as the endless film in the thermal fixing device of SURF system, the fluoro-resin layer is liable to peel off the endless film. That is, the endless film is low in durability. In addition, the thin polyimide film is low in mechanical strength. Therefore, there is a limitation in the use of the polyimide film surface-treated with fluoro-resin as the endless film in the thermal fixing device of SURF system which is of a middle fixing speed or of a high fixing speed. On the other hand, an annular metal film is much greater in mechanical strength than the polyimide film, and it may have a rough surface such as a satin-finished surface which is suitable for the formation of a fluoro-resin layer. That is, the fluoro-resin layer adheres firmly to the annular metal film. Thus, the annular metal film of the invention is considerably high in durability.

In the final step in manufacture of the annular metal film by electrocasting, a thin compound plated surface is formed on the annular metal film in which particles are dispersed and impregnated so that they are eliminated by oxidation when baked in an oxidizing atmosphere. Alternatively, in the final step in manufacture of the annular metal film by electro-casting, a porous chromium plated surface is formed on the surface. The surface of the annular metal film thus processed is uneven, thus being suitable for formation of the fluoro-resin layer on it. That is, the fluoro-resin layer adheres strongly to the surface of the annular metal film.

By mixing particles of lubricant such as $MoS_2$, C (graphite) or polymer (fluoro-resin) in an electrocasting bath (plating bath), an electrocasting can be obtained in which the particles are dispersed and impregnated. The particles may be impregnated only in the surface layer to improve the lubricity. The same effect can be obtained by applying this surface treatment to the inner surface of the annular metal film.

In addition, by subjecting the surface of the elongated heat generating unit to lubrication treatment with $MoS_2$ or the like, the annular metal film can be smoothly slid on the elongated heat generating unit with less torque.

Since the annular metal film is surface-treated readily in the above-described manner, the force of adhesion of the lubricative resin layer to it is also is increased. In combination with the high mechanical strength of the annular metal film, the thermal fixing device is greatly increased in service life. This is the reason why the thermal fixing device of the invention is applicable for electrophotographing apparatuses ranging from low speed ones to high speed ones.

A function of the thermal fixing device of the invention will be described next function which makes it possible to apply the device to all electrophotographing apparatuses ranged from low speed ones to high speed ones. That is, in the endless annular metal film, no temperature difference is detected in the direction of thickness when heated by the elongated heat generating unit. This means that the temperature of the elongated heat generating unit can be set close to 130° C. which is the temperature required for fixing the transfer sheet. In practice, as was described above, an offset preventing fluoro-resin (PTFE or the like) layer is formed on the outer surface of the annular metal film generally to a thickness of about 10 μm. Therefore, it is necessary to set the temperature of the heat generating unit to 140° to 150° C. However, since the annular metal film is much higher in thermal conduction than the polyimide film, the power consumption is greatly reduced. It is obvious that the thermal efficiency is further improved by employing a direct heating method such as a radiation heating method, electrical heating method or electromagnetic induction heating method.

In the case of a low speed thermal fixing device which is low in power consumption, employment of the endless annular metal film results in a further decrease in power consumption. As a result, a positive characteristic thermistor heater (hereinafter referred to as "a PTC heater", when applicable) may be employed as the heater in the elongated heat generating unit. The PTC heater, as is well known in the art, is a heater of self heat generation and self control type which, when its ambient temperature decreases, automatically increases an amount of generation of Joule heat, to thereby maintain a constant temperature. The operating temperature of the PTC heater is determined according to the material of the heater, and it can be selected freely from a range of from 100° C. to 300° C. The PTC heater is a low heat output type element, and it has been applied, in various manners, to a heat generating unit provided for a heat roller. It is said that all experiments on application of the PTC heater to the heat generating unit have resulted in failure. It is believed that the reason for the failure is as follows: It is considerably difficult to make the PTC heater cylindrical, and therefore similarly as in the case of the conventional heat roller, a method of using the PTC heater instead of the halogen lamp or sheathed heater has been researched in various manners. In this case, it is required for the PTC heater to have a heat generating function which is the same as that of the halogen lamp. However, judging from the performance of the PTC heater, it is impossible for the PTC heater to have such a heat generating function. Thus, all the experiments have resulted in failure. On the other hand, research on the employment of the PTC heater in a thermal fixing device of SURF system using a polyimide film has not been reported in the art yet. So, we have made the research, and obtained prospects that it can be realized (cf. Japanese Patent Application (OPI) No. 67081/1992). However, there has remained a major problem that the endless heat-resisting resin film is low in thermal conduction and short in service life. What radically solved the problem is the annular metal film according to the invention.

The most significant feature of the heat roller including the PTC heater resides in that it eliminates the temperature sensor and the temperature control unit from the thermal fixing device of SURF system. That is, the employment of the heat roller makes it possible to greatly decrease the number of components, to reduce the size and to simplify the construction of the thermal fixing device. In addition, as was described before, both the heat generating unit's temperature and the heating electric power can be reduced.

On the other hand, in the case of a middle speed thermal fixing device or a high speed thermal fixing device which requires large heating electric power, employment of the PTC heater is not suitable, because its heating capacity is not high enough. However, in this case, the following heating methods may be employed: an indirect heating method using a heater of resistance heating type which is fundamentally not limited in heating capacity, or a direct heating method such as a radiation heating method, electric heating method or electromagnetic induction heating method. And the heating range can be limited to a thermal fixing range required. This means that, because of the employment of the annular metal film, not only the heating unit's temperature and the heating electric power are reduced, but also the endless film itself is increased in service life, and the excellent characteristics of the SURF system can be applied to a high speed thermal fixing device.

In the case where the elongated heat generating unit is made up of two slide electrodes arranged in parallel with each other, or an electromagnetic induction heating coil with a magnetic core made of a material high in magnetic permeability, the annular metal film itself can be used as a heating element. Therefore, in the case where the elongated heat generating unit of electric heating type or electromagnetic induction heating type is employed, the annular metal film shows specific features which cannot be provided by the heat-resisting annular resin film.

In the case where the elongated heat generating unit of radiation heating type is employed, it is preferable to blacken the inner surface of the annular metal film which is brought into contact with the elongated heat generating unit, to thereby increase the light absorption coefficient.

In order to smoothly turn the annular metal film thereby to increase the service life of the latter, it is preferable that the slide surface of the elongated heat generating unit be shaped so that it is larger in curvature on the side where the image support is let in (hereinafter referred to as "an image support inlet side", when applicable) than on the side where the image support is let out (hereinafter referred to as "an image support outlet side", when applicable). This difference in curvature allows the image support the thermal fixing device with ease, and to leave the annular metal film readily.

In the thermal fixing device of the invention, the heat generating unit and the cooling unit are in contact with the endless metal belt, so that the heat generating unit heats the metal belt on the image support inlet sides and the cooling unit cools it on the image support outlet side. Hence, the toner not fixed yet is heated to higher than the melting point on the transfer sheet inlet side so that it is molten and permeated in the transfer sheet. Thereafter, it is cooled on the transfer sheet outlet side, and separated from the endless metal belt. The surface of the endless metal belt is covered with lubricative resin, and therefore as long as the above-described temperature conditions are satisfied, the low temperature offset or the high temperature offset will never occur. Both the heating temperatures of the heat generating unit with the PTC thermistor heater as its heat source, and the cooling temperatures of the cooling unit are wide in allowable range, and therefore the temperature control can be achieved with ease.

This means that the thermal fixing device has novel features. That is, all kinds of toner which are substantially equal in glass transition point can be satisfactorily fixed. Even in the case where transfer sheets different in size are thermally fixed, the low temperature offset and the high temperature offset will never occur. Employment of the endless metal belt high in thermal conduction makes it possible to perform both the heating operation and the cooling operation in the narrow nipping region in the thermal fixing device. In addition, employment of the PTC thermistor heater element makes it unnecessary to use the temperature sensor, and temperature controlling power source, and eliminates the use of microcomputer control. This contributes greatly to reduction of the number of components in the thermal fixing device, and to miniaturization of the latter, and to reduction of the manufacturing cost.

In the thermal fixing device, its support is made of metal so that it may be high in heat radiation. Thus, it is unnecessary to provide cooling means such as the support itself. The support is made U-shaped in section, and its upper end portions are utilized for heat radiation. The heat radiating effect can be improved by forming fins on the support. In order to positively cool those upper end portions for heat radiation, a fan may be employed.

In the heat generating unit, the PTC thermistor heater can be replaced when necessary. Therefore, when it is required to handle the toner which is greatly different in glass transition point, a PTC thermistor heater suitable for the toner can be used.

Preferred embodiments of this invention will be described with reference to the accompanying drawings.

First Embodiment

An example of a thermal fixing device, a first embodiment of the invention, will be described with reference to FIG. 1. In the device, a PTC heater is employed as a heat generating element. The heat generating element comprises a heat roller 11 and a pressure roller 12. Roughly stated, the heat roller 11 comprises a stationary PTC heater section (including a PTC heater 1, a heat insulator 2, and a frame 3); an endless annular film 4 of metal (hereinafter referred to as an "endless film 4); and a drive roller 5 adapted to turn the endless film 4 in synchronization with the pressure roller 12 while pushing the endless film 4 against the PTC heater 1. The pressure roller. 12 is made up of a rotary core 10, and a heat resisting elastic member 9 of silicon rubber or fluoro-rubber which is formed on the cylindrical wall of the rotary core 10. In order to prevent the offset of toner, a layer of fluoro-resin (PTFE or polytetrafluoroethylene) is formed on the outer surface of the endless film 4 to a thickness of about 10 μm.

In the thermal fixing device, the pressure roller 12 is turned in the direction of the arrow while being pushed against the heat roller 11 so that an image support, namely, a sheet 8 is brought into contact with the heat roller 11 and an sufficient amount of heat is transmitted to the sheet 8 and the toner 7 on it which is not fixed yet. In order to decrease the drive torque, and to increase the service life of the endless film 4, the heat insulator 2 is made larger in curvature on the sheet inlet side than on the sheet outlet side.

Figure 2:
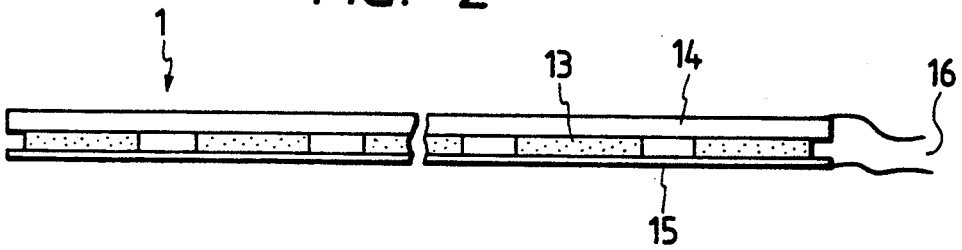
FIGS. 2 and 3 are side view and a cross sectional view showing an example of a PTC heater in the thermal fixing device shown in FIG. 1, respectively.
Figure 3:
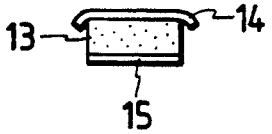

A concrete example of the PTC heater 1 in the heat roller 11 is as shown in FIGS. 2 and 3. The PTC heater 1 comprises PTC heater elements 13 which are each 2.0 mm in thickness, 5.0 mm in width and 12 mm in length and provided with an upper electrode 14 and a lower electrode 15 so that current is applied in the direction of thickness. In the PTC heater, the upper electrode 14 has a structural strength, and the upper electrode 14 and the lower electrode 15 are electrically and thermally connected to the PTC heater elements 13 by high temperature soldering. The Curie temperature of the PTC heater elements 13 is 150° C. In the example, fourteen PTC heater elements 13 are arranged with a space 5 mm therebetween as shown in FIG. 2. In this connection, it goes without saying that the number and size of PTC heater elements 13, and the material and dimension of the upper and lower electrodes 14 and 15 depend on an amount of heat to be generated and on a manufacturing cost given. Upon application of a voltage of AC 100 volts to lead wires 16 connected to the PTC heater 1, the temperature of the PTC heater was raised to about 150° C. in five or six seconds, and it was maintained at the temperature stably. In application of a voltage of AC 200 volts to it, it took about two seconds for the temperature of the PTC heater to reach about 150° C. In the case where it is allowed to increase the temperature rise time, it is preferable to increase the specific resistance of the PTC heater elements 13 thereby to decrease the rush current. The surface temperature of the upper electrode 14 shows a temperature difference of the order of ±10° C. during temperature rise. This is because the PTC heater elements 13 are fluctuated in resistance, and the PTC heater 1 is formed with such PTC heater elements. However, after the temperature of the PTC heater reached about 150° C. in five or six seconds, the upper electrode 14 was uniform (within ±2° C. in this case) in temperature distribution in its entirety. When a part of the upper electrode 14 was forcibly cooled, only around it, the temperature was decreased 5° or 6° to 10° C. However, upon suspension of the forcible cooling operation, the temperature distribution became uniform again in one second. This is one of the excellent characteristics of the PTC thermistor heater; That is, only the element cooled increases the amount of heat to make the temperature distribution uniform. This is particularly effective in the case where sheets small in size and sheets large in size are alternately subjected to thermal fixing. This will be described below in more detail. In the conventional system, in response to instructions from one temperature sensor, one control electric power unit operates to control one heater for heating the whole heat roller. Hence, after a sheet small in size has been subjected to thermal fixing, the part of the surface of the heat roller which was in contact with the sheet is lower in temperature. Therefore, when under this condition a sheet large in size is subjected to thermal fixing, then a high temperature offset or a low temperature offset is liable to occur locally on the sheet. In practice, in order to eliminate this difficulty, it is necessary to provide a variety of countermeasures. On the other hand, in the PTC heater 1 of the invention, all the PTC heater elements 13 function by themselves to make the whole PTC heater equal to the predetermined Curie temperature. Therefore, it is unnecessary for the PTC heater to employ countermeasures such as those for the conventional system. It should be noted that each of the PTC heater elements 13 functions by itself as described above.

The operation of the PTC heater 1 has been described as its own characteristic. However, the operation is effected in the heat roller 11 including the endless annular metal film 4.

The endless annular metal film 4 was formed by an electrocasting method which was considered to satisfy a given specification and is excellent in mass production. The electrocasting method is substantially the same as to an electroplating method. The former is different from the latter only in the following point: A thin oxide film is formed on the surface of a base mold which serves as an electrode, and is then plated. The oxide film thus treated, namely, an electrocasting, is removed from the base mold by heating and cooling it. The base mold may be used again. The electrocasting thus formed was employed as the endless annular metal film 4.

By mixing fine particles of lubricative material such as $MoS_2$ in an electrocasting bath (or plating bath), a plated electrocasting was obtained. In addition, an electrocasting was obtained only in the surface of which fine particles of $MoS_2$ or the like were dispersed and impregnated. A method of dispersing and impregnating $MoS_2$ or the like in a surface was applied to the outer surface of the upper electrode 14 of the PTC heater 1, so as to improve the slidability of the endless annular metal film 4 and to reduce the torque for turning the latter 4. In this case, it was found that the torque was reduced to about half. The same effect was obtained by applying the method to the inner surface of the endless film 4.

Another concrete example of the thermal fixing device according to the invention was formed. In the example, the endless annular metal film 4 was made of pure nickel (Ni). However, with other metal materials, fundamentally the same effects were obtained.

The surface of an electrocasting of pure nickel 25 μm in thickness was satin, and it was observed to be uneven, or the order of ±2 μm, under an SEM. A fluoro-resin film was formed on the uneven surface to a thickness of about 10 μm. The endless film 4 thus formed was applied to the thermal fixing device shown in FIG. 1, and subjected to a duration test corresponding to the operation of fixing several ten thousands to a hundred thousands of sheets with a fixing speed of 6 cpm/A4. As a result of the test, the fluoro-resin film was partially peeled off; however, the remaining was found normal. Thus, the heat roller having the endless film thus formed is applicable to an electrophotographic apparatus employed, for example, in facsimiles.

In order to increase the service life of the heat roller, the latter was improved as next described. An electrocasting film of pure nickel 20 μm was formed, and an electrocasting film of pure nickel with fine particles of polystyrene divinyl benzene copolymer 8 to 10 μm in particle size dispersed and impregnated was formed on it to a thickness of about 6 μm, to form a structure. The structure thus formed was washed and dried, and baked at 350° to 400° C. in the air, and then covered with a fluoro-resin (PTFE) film by a conventional method. The baking operation is essential for covering it with the fluoro-resin film. However, it should be noted that the baking operation functions to oxidize the polymer fine particles in the surface of the electrocasting of nickel to eliminate them to thereby make the surface uneven with fine scratches so that the fluoro-resin is caused to strongly adhere to the uneven surface. It has been confirmed that the fluoro-resin film thus formed is no longer peeled off, and it can be used until its predetermined service life expires. This means that the heat roller thus formed is equal in service life to the conventional heat roller. It has been confirmed that the present system can be employed for a high speed fixing device when the thickness of the fluoro-resin film is set to 15 to 25 μm. In order to make the surface of the electrocasting uneven with fine scratches as described above, fine particles of bridge acryl, bridge polystyrene or latex can be equally employed as well as the above-described fine polymer particles. In addition, the same effects were obtained with an endless annular metal film formed as follows. An electrocasting of nickel (Ni) was formed to a thickness of about 20 μm, and then subjected to porous chromium plating. A fluoro-resin film was formed on the electrocasting thus processed.

Even if the nickel electrocast film is made smaller in thickness, it will provide no problem in performance. However, the employment of such a thin endless annular metal film results in a problem that it is difficult to manufacture and assemble. In contrast, the thickness of the electrocast film may be increased with the performance maintained unchanged. However, the employment of such a thick endless annular metal film is disadvantageous in that the loss of heat is somewhat increased. In the case of a high speed thermal fixing device, it is preferable that the thickness of the metal film is in a range of from 30 μm to 50 μm, because the device is bulky, and the metal film can be handled with ease.

Figure 4:
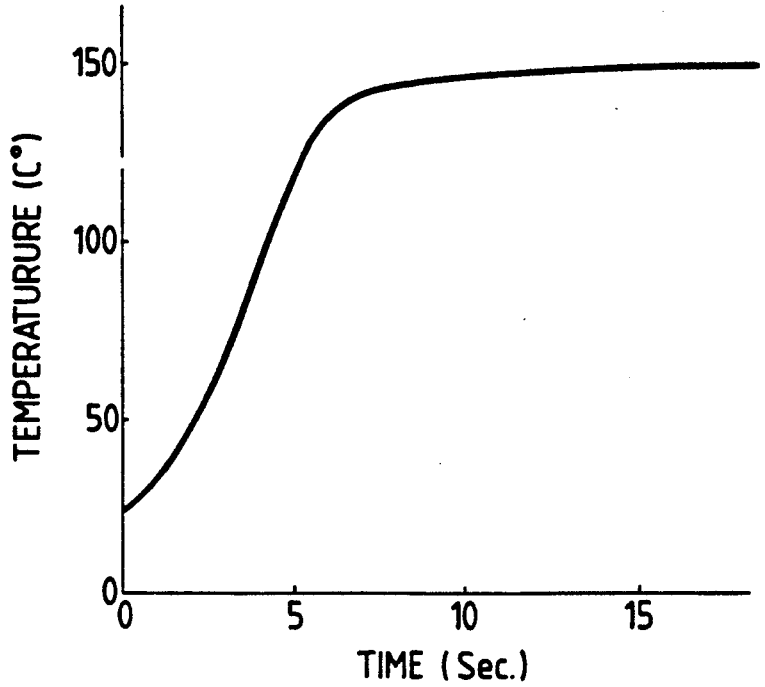
FIG. 4 is a graphical representation indicating a temperature rise characteristic of the thermal fixing device shown in FIG. 1.

FIG. 4 shows a temperature rise characteristic of the surface (the central portion of the PTC heater 1) of the endless annular nickel film (about 25 μm in thickness) on which a fluoro-resin film is formed to a thickness of 10 μm. The characteristic was measured with the pressure roller 12 and the transfer sheet omitted. Hence, the temperatures measured were higher about 20° C. than designed.

In the case where the endless annular nickel film 4 was 20 to 50 μm in thickness, the temperature of the surface of the nickel film 4 on the side of the sheet was 135° to 140° C. when the PTC heater was at 150° C. As is apparent from the above description, although the PTC heater heated the endless annular nickel film 4, the distribution of temperature in the film 4 was substantially uniform in the direction of thickness. That is, there was substantially no temperature difference detected in the direction of thickness; and when detected, the temperature difference was mainly due to the difference in thermal capacity between the fluoro-resin layer and the annular metal film.

With the thermal fixing device thus constructed, a sheet of A4 size was subjected to fixing. In this case, the upper limit of a fixing speed was about 10 cpm/A4. The fixing speed can be increased by decreasing the specific resistance of the PTC heater elements 13. However, this method is not always advantageous with the latest technique, because it is rather troublesome to obtain PTC heater elements equal in resistance. That is, selection of the PTC heater elements is low in yield. The low thermal output of the PTC heater 1 is one of the problems to be solved in the future.

Second Embodiment

A second embodiment of the invention is the same in fundamental structure as the first embodiment described above. That is, in the second embodiment, its PTC heater 1 is slightly different from the one in the first embodiment.

Figure 5:
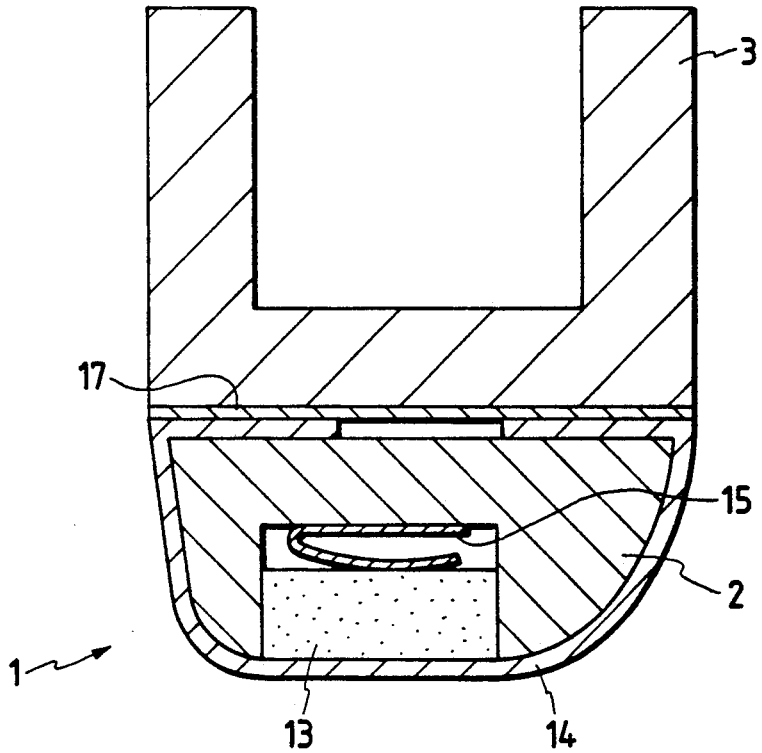
FIG. 5 is a sectional view showing another example of the PTC heater.

In the first embodiment, the PTC heater elements 13, the upper electrode 14 and the lower electrode 15 are electrically and thermally connected to one another by high temperature soldering. On the other hand, in the second embodiment, those components are electrically and thermally connected to one another with spring means. That is, as shown in FIG. 5, a lower electrode 15 which is elastic, and PTC heater elements 13 are put in the recess of the heat insulator 2 U-shaped in section, and those components are covered completely with a plate-shaped upper electrode 14, thus providing a heater. The PTC heater elements 13 are electrically and thermally connected to the upper electrode 14 by the elastic force of the lower electrode 15. The heater thus formed is secured to the frame 3 through an insulating sheet 17. A specific feature of the PTC heater thus constructed resides in the fact that the PTC heater elements 13 are isolated from the atmosphere around the thermal fixing device. However, it is disadvantageous in that the contact thermal resistance of the PTC heater elements 13 and the upper electrode 14 is somewhat increased. This difficulty can be eliminated by applying grease high both in electrical conduction and in thermal conduction to the contact interface or by connecting them by high temperature soldering. However, in the case where the fixing speed was of the order of 6 cpm/A4, no troubles occurred without employment of those methods.

The loss of heat due to the increase in area of the upper electrode 14 was made substantially equal to the loss of heat in the above-described first embodiment by forming it with stainless steel low in thermal conductivity.

Third Embodiment

A third embodiment of the invention is similar in fundamental structure to the above-described first embodiment. In the third embodiment, instead of the PTC heater 1 (FIG. 1) an ordinary resistance heater (not shown) is employed. That is, since the amount of heat generated by the PTC heater is limited, a resistance heating source is used to obtain a fixing speed of 15 to 20 cpm/A4 or higher. A heating source of 500 W to 1000 W can be readily obtained, and therefore a thermal fixing device having a fixing speed of 100 cpm/A4 can be manufactured with ease. That is, a thermal fixing device of endless film type can be readily formed which has such a high fixing speed. This is due to the fact that the employment of the endless annular metal film makes it possible to reduce the difference in temperature between the heating source and the surface of a fixing sheet. The thermal fixing device of endless film type is advantageous in that a temperature measurement can be carried out with a temperature sensor slidably set on the rear surface of the belt, and it is unnecessary to provide a sheet separating pawl, and accordingly it is unnecessary to provide an offset preventing silicon oil supplying unit.

In the third embodiment, unlike the first and second embodiments, it is necessary to use a temperature sensor and a temperature controlling power source similarly as in the conventional system such as the SURF system.

Fourth Embodiment

Figure 6:
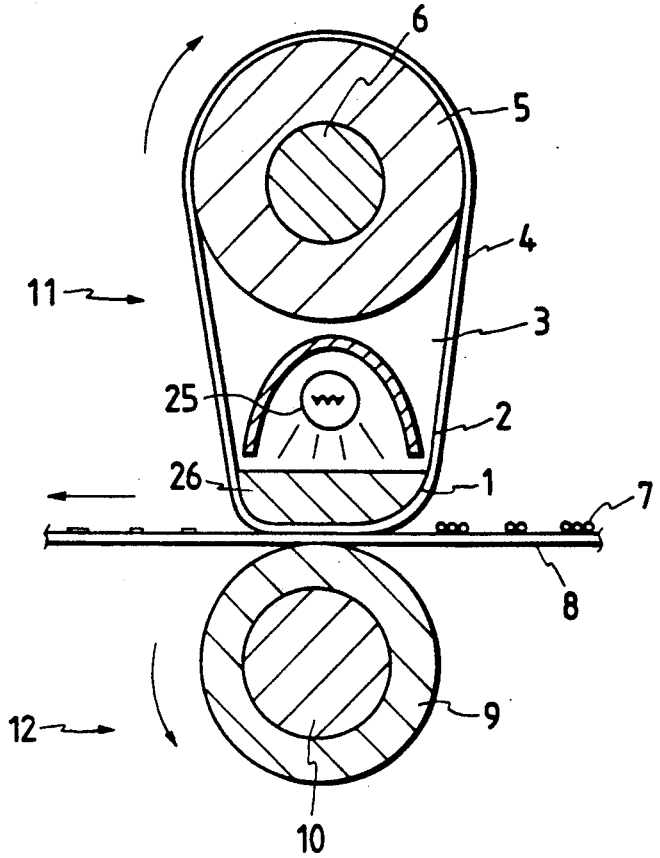
FIGS. 6, 7 and 8 are sectional views showing examples of an elongated heat generating unit in the thermal fixing device according to the invention.

A fourth embodiment of the invention is similar in fundamental structure to the above-described first embodiment. In the first embodiment, the endless annular metal film 4 is heated by conduction with the PTC heater 1, whereas in the fourth embodiment, it is directly heated by radiation with an infrared lamp 25 as shown in FIG. 6. The inner surface of the endless annular metal film 4 is made black so as to absorb heat radiated from the infrared lamp. The fourth embodiment is advantageous in that the endless annular metal film is heated quickly. That is, the thermal efficiency is high. However, it is still disadvantageous in that the endless annular metal film 4 may be scratched while sliding on a transparent board (of glass) 26, and therefore it is relatively short in service life. The fourth embodiment needs a thermometer and a controlling power source. However, similarly as in the above-described third embodiment, the fourth embodiment also has the above-described merits attributed to the employment of the endless annular metal film 4.

Fifth Embodiment

Figure 7:
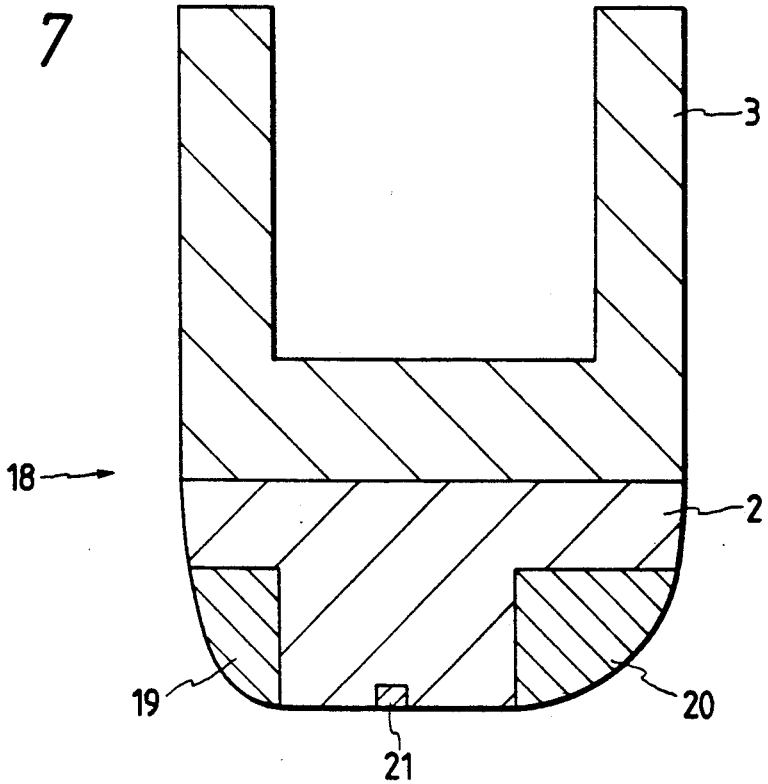

A fifth embodiment is also similar in fundamental structure to the above-described first embodiment. In the first embodiment, the endless annular metal film 4 is heated by conduction with the PTC heater 1 as shown in FIG. 1; whereas in the fifth embodiment, electric current is directly applied to the endless annular metal film 4 through two bar-shaped electrodes so that the metal film 4 is directly heated. That is, the fifth embodiment, as shown in FIG. 7, employs an elongated heat generating unit 18. In FIG. 7, reference numerals 19 and 20 designate metal electrodes the surfaces of which have been subjected to lubrication treatment. AC voltage or DC voltage is applied to those electrodes 19 and 20 while the endless annular metal film 4 (not shown) is turned around while being in contact with the electrodes. As a result, electric current flows in the endless annular metal film between the two electrodes, to heat it. In this operation, electric current flows also in the opposite side of the metal film to heat the latter, and the amount of heat generated there is about 1/20 of the total, and the heat generation surface density is extremely small, being about 1/400. The temperature sensor 21 is used to measure the temperature of the inner surface of the endless annular metal film 4. The temperatures measured with the temperature sensor 21 are different only 5° to 10° C. from the outer surface temperatures. The thermal fixing device according to the fourth embodiment is considerably high in thermal response when voltage is applied to the electrodes. Hence, the application of voltage to the electrodes should be carried out only when the fixing sheet passes through the thermal fixing device. Thus, the thermal fixing device of the invention is most economical in power consumption.

With the thermal fixing device, a fixing speed of 150 cpm/A4 or higher can be obtained with ease. And the thermal response is so high that the device becomes ready for operation instantaneously. That is, the device is considerably high in thermal efficiency. Theoretically stated, no system can provide a thermal efficiency higher than the instant system.

Sixth Embodiment

Figure 8:
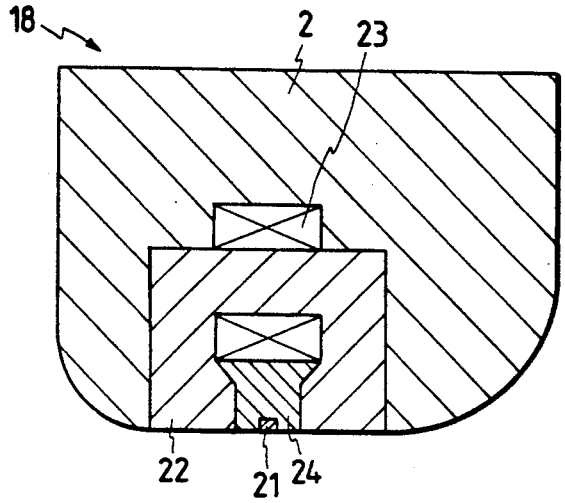

A sixth embodiment is also similar in fundamental structure to the above-described first embodiment. In the first embodiment, the endless annular metal film 4 is heated by conduction with the PTC heater 1 as shown in FIG. 1, whereas, in the sixth embodiment, the endless annular metal film is directly heated by electromagnetic induction with an elongated electromagnet which is in contact with the metal film. That is, the sixth embodiment, as shown in FIG. 8, employs an elongated heat generating unit 18. In FIG. 8, reference numeral 22 designates a Ba ferrite core small in AC loss; 23, a coil wound on the ferrite core 22; 21, a temperature sensor for detecting the temperate of the inner surface of the endless annular metal film; and 24, an alumina-filler-contained heat-resisting resin member which fixedly holds the temperature sensor 21 and lessens the wear of the latter. In FIG. 8, the frame is not shown; however, it goes without saying that, similarly as in the above-described embodiments, it is employed as a structural member. Formation of the heat insulator 2 and the heat-resisting resin member 24 as one unit by using alumina-filler-contained heat-resisting resin is suitable for mass production of the thermal fixing device.

The sixth embodiment employs a direct heating method which is fundamentally the same as that in the fifth embodiment. In addition, in the sixth embodiment, the thermal response and the thermal efficiency are substantially equal to those in the fifth embodiment. However, it should be noted that the sixth embodiment is superior to the fifth embodiment in that the endless annular metal film is heated without the slide electrodes. In the case where the endless annular metal film is of nickel (Ni), it can be sufficiently heated with AC current of commercial frequency, 50 or 60 Hz. This is advantageous for reduction of the manufacturing cost, although it is necessary to employ a temperature controlling power source.

The heat roller thus constructed may have a heating capacity of 500 to 1000 W, thus being applicable as a middle speed heat roller or high speed heat roller. The characteristics are substantially equal to those of the fifth embodiment.

Seventh Embodiment

Another example of the thermal fixing device, which constitutes a seventh embodiment of the invention, will be described with reference to FIG. 9.

Figure 9:
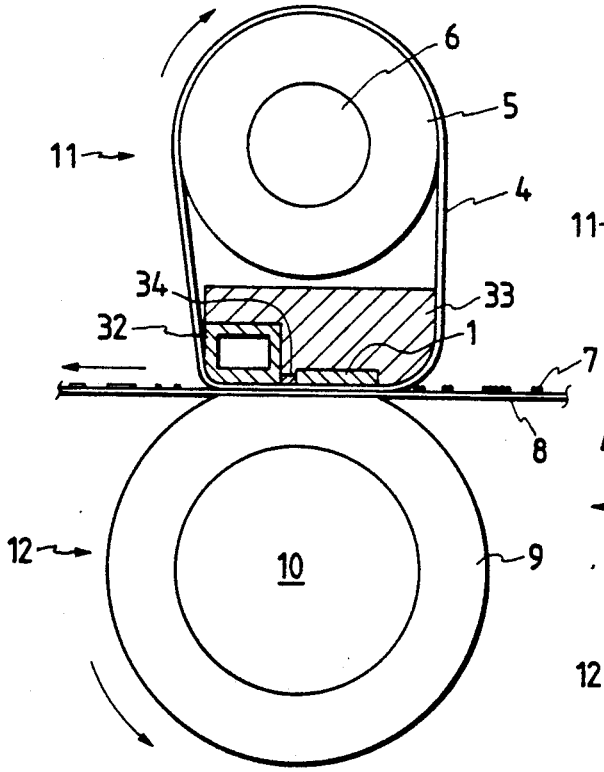
FIG. 9 is a sectional view showing another example of the thermal fixing device according to the invention.

As shown in FIG. 9, the thermal fixing device comprises a heat roller 11, and a pressure roller 12. Roughly stated, the heat roller 11 comprises an endless annular metal film 4, and a drive roller 5. The outer surface of the metal film 4, which is on the side of a heating and cooling section (described later), is covered with a layer of lubricative resin. The drive roller 5 is adapted to turn the endless annular metal film 4 in synchronization with the pressure roller 12 while setting the endless annular metal film 4 at the heating and cooling section. The heating and cooling section is made up of a heat generating resistor 1, a cooling unit 32, a temperature sensor 34, and a heat-resistive heat-insulating support 33 which supports those components 1, 32 and 33 as one unit. The pressure roller 12 is made up of a rotary core 10, and a heat-resisting elastic layer of silicon rubber or fluororesin formed on the cylindrical wall of the rotary core 10.

A support, namely, a transfer sheet 8, on which an image of toner 7 is formed and is not yet fixed, is brought into contact with the heat roller 11, so that the toner 7 is molten and stuck on the transfer sheet 8. In order to cool and solidify the toner thus molten, the pressure roller 12 is turned in the direction of the arrow while being pushed against the heat roller 11. In the heat roller 11, the heating and cooling section is shaped so that it is larger in curvature on the sheet inlet side than on the sheet outlet side. This is to decrease the drive torque, and to increase the service life of the endless annular metal film 4, and to facilitate the introduction of the transfer sheet 8. As was described above, in the heating and cooling section, the curvature is smaller on the sheet outlet side. This is to allow the transfer sheet 8 to leave the endless annular metal film 4 with ease. This structure eliminates the transfer sheet separating pawl.

In the thermal fixing device thus constructed, the heat roller 11 is heated as follows: That is, the heat generating resistor 1 is used as a heater, which is .in the form of a thick film formed on a grazed glass ceramic substrate by sintering. The heating temperature of the heat roller is controlled as follows: The temperature of the inner surface of the endless annular metal film 4 is detected with the temperature sensor 34, and the current applied to the heat generating resistor 1 is controlled according to the temperature thus detected, so as to provide a suitable heating temperature. The temperature sensor 34 may be disposed behind the heat generating resistor 1. The cooling unit 32 is for instance a heat pipe with a medium of water, which is connected to an air cooled radiator (condenser) set beside the heat roller 11. That is, the cooling unit 32 is adapted to reduce the temperature of the endless annular metal film to 100° C. or less which is in contact with the cooling unit.

Electric power was applied so that the surface temperature of the heat generating resistor 1 was raised to 160° to 180° C. with a middle fixing speed of 20 cpm (copies per minutes)/A4, and 250° to 300° C. with a high fixing speed of 100 cpm/A4. In this case, the temperatures detected by the temperate sensor were not so variable, being in a range of 150° to 160° C. And even when those temperatures were raised by 50° or 60° C., the high temperature offset was not caused. This is due to the fact that, as was described before, while the transfer sheet is being pushed against the endless annular metal film 4 cooled by the cooling unit 32, the toner molten is solidified, and it is completely solidified when the transfer sheet 8 leaves the endless annular metal film 4. As is apparent from the above description, when the surface temperature of the heat generating resistor 1 is increased, then the power consumption is increased as much. However, with the surface temperature of the heat generating resistor set in this way, the degree of freedom in temperature control is increased, and the control system can be simplified to the same extent.

Thus, it can be understood from the above description that, even in subjecting a plurality of sheets different in size to thermal fixing, no low temperature offset is caused if the lowest temperature which the heat generating resistor 1 provides locally is much higher than the toner melting temperature, and the cooling unit prevents the occurrence of high temperature offset.

It is one of the specific features of the thermal fixing device that, an envelope fixing function can be performed. That is, the fixing operation can be achieved with the flat portion of the heat roller.

It is another specific feature of the thermal fixing device of the invention that the device starts quickly. With a power source having a practical capacity, one second is long enough to raise the temperature of the heat generating resistor 1 to 200° to 300° C. For instance, in an electrophotographing apparatus having a fixing speed of 50 cpm/A4, it requires only 0.5 to 1 second for a transfer sheet to reach the thermal fixing device from the transfer drum. This means that the thermal fixing device can be energized simultaneously when a printing operation starts. Thus, an electrophotographing apparatus can be provided according to the invention in which it is unnecessary to perform a preheating operation. When the fact is taken into consideration that it is essential for all the conventional electrophotographing apparatuses to perform a preheating operation, it can be understood how effectively and greatly the power consumption is reduced according to the invention.

The seventh embodiment may be modified in various manners as next described. These modifications are similar in fundamental structure to the above-described seventh embodiment. In one of the modifications, instead of the heat generating resistor 1, a halogen lamp is employed to directly heat the endless annular metal film. In another modification, the endless annular metal film 4 is heated by applying current directly to it or by electromagnetic induction. In another modification, the heat pipe is eliminated, and instead a cooling unit 32 with cooling fins are provided for forcibly cooling the endless annular metal film. In addition, the heating and cooling operations can be electrically carried out in accordance with the Peltier effect. However, the above-described first embodiment is most effective in manufacturing cost, performance, and miniaturization.

Eighth Embodiment

Figure 10:
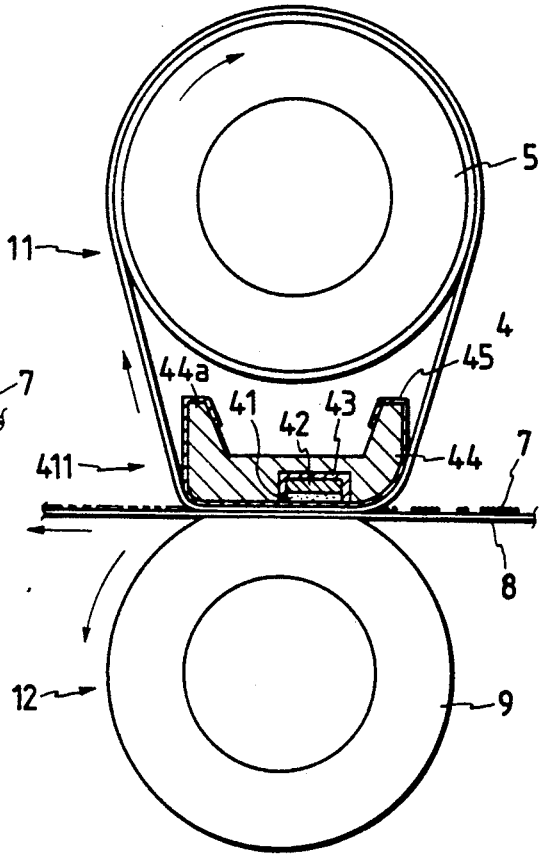
FIG. 10 is a sectional view showing another example of the thermal fixing device according to the invention.

FIG. 10 shows another example of the thermal fixing device, which constitutes an eighth embodiment of the invention. The thermal fixing device, as shown in FIG. 10, comprises a heat roller 11, and a pressure roller 12. Roughly stated, the heat roller 11 includes a heating and cooling unit 411, an endless metal belt 4, the outer surface of which is covered with a layer of lubricative resin, and a drive roller 5 adapted to turn the endless metal belt 4 in synchronization with the pressure roller 12 while pushing the endless metal belt 4 against the heating and cooling unit 411. The heating and cooling unit 411 includes a PTC thermistor heater 41, a currently applying spring electrode 42, a heat insulator 43, an aluminum frame 44, and a thin stainless steel plate 45 which fixedly holds those components by embracing them. The pressure roller 12 is made up of a rotary core, and a heat-resisting elastic layer of silicon rubber or fluoro-resin formed on the cylindrical wall of the rotary core. The pressure roller 12 is pushed against the heat roller 11 at a pressure of 3 to 10 kg. This pressure is determined from the hardness of the heat-resisting elastic layer of the pressure roller, the width of the fixing device (corresponding to the size A4, A3, etc. of transfer sheets), fixing speed, heating temperature, cooling temperature, heating capacity, and cooling capacity. In the eighth embodiment, the amount of deformation of the pressure roller is reduced to about half when compared with that of the conventional heat roller. Hence, in the thermal fixing device, the pressure for pushing the pressure roller against the heat roller can be reduced, and accordingly fixing sheets are effectively prevented from being creased. The reduction in the amount of deformation of the pressure roller 12 results in the fact that the pressure roller is substantially doubled in service life, and in practice it is unnecessary to give maintenance to the pressure roller.

The PTC thermistor heater 41 is heated by current applied through the spring electrode 42, and almost all the amount of heat generated thereby is transmitted to the stainless steel plate 45 which is in contact with the PTC thermistor heater 41. The stainless steel plate 45 is used to secure the PTC thermistor heater 41. In order to facilitate the assembling work of the thermal fixing device, the thickness of the stainless steel plate 45 is set to 100 to 150 μm. In the stainless steel plate 45, the amount of transmission of heat in the direction of surface of the plate is much smaller than in the direction of thickness; that is, it can be disregarded. This is because stainless steel is relatively small in thermal conductivity although it is metal.

The Curie temperature of the PTC thermistor heater 41 should be higher by 10° to 20° C. than the temperature required for fixing toner because the stainless steel plate 45 and the metal belt 4 are high in heat conductivity. On the other hand, it is advantageous in manufacturing cost and in production design if it is possible to realize a thermal fixing device which can be used for a plurality of kinds of toner which are similar in melting point. Therefore, a PTC thermistor heater should be employed which is higher in Curie temperature. Even in this case, the occurrence of offset is completely eliminated by the instant system in which the toner leaves the metal belt after being cooled. That is, merely by providing two or three PTC thermistor heaters different in Curie point, thermal fixing devices which are completely equal in external appearance can be employed in a variety of low speed electrophotographic apparatuses. This is a novel specific feature of the invention.

The left half of the heating and cooling unit 411 shown in FIG. 10 is a cooling section which provides the above-described significant effect. The embodiment relates to the thermal fixing device of low fixing speed which can utilize the PTC thermistor heater 41 and does not need to be so large in cooling capacity. For instance, in heating the toner 7 of a fixing temperature 120° C. with the PTC thermistor heater 41 which has not been fixed yet, the Curie temperature of the PTC thermistor heater 41 is high enough at 140° C. In order to prevent the occurrence of offset when the sheet leaves the device with the toner cooled, the temperature of the toner should be reduced to about 100° C. For this purpose, in the heating and cooling unit 411, the temperature of the cooling section of the aluminum frame 44 should be held at about 80° C. or less. This is the reason why the frame 44 is made of aluminum high in thermal conductivity. In addition, by using aluminum, a structure intricate in sectional configuration can be formed with high accuracy by extrusion molding. Thus, aluminum is most suitable for formation of the frame 44 light in weight and low in manufacturing cost. The frame U-shaped in section as shown in FIG. 10 can be readily made of aluminum. The frame thus formed is satisfactory both in rigidity and in radiation area.

It is not always necessary to provide an air cooling fan for the thermal fixing device. However, in the case where it is required to provide a thermal fixing device which is to be used continuously for a long period of time, it is preferable to allow cooling air to flow in the space between the heating and cooling unit 411 and the drive roller 5, or to form cooling fins (not shown) on the aluminum frame 44; that is, to employ a natural cooling method.

The metal belt with the lubricative resin layer has been illustrated in the above-described embodiment in detail. The contents of the specification of the patent application may be applied to the eighth embodiment as well. However, a method of manufacturing the metal belt will be briefly described hereunder. For instance, a nickel belt is formed to a thickness of 30 μm on the surface of a stainless steel base mold by electrocasting. In the same electrocasting bath, with the electrical polarity inverted, the nickel belt is electrolytically etched to about 5 μm. As a result, the surface of the nickel belt is formed into an uneven surface having dimples which is most suitable for forming a layer of fluoro-resin (PTFE}on it. In the method, only one kind of electrocasting bath is employed, and the manufacturing steps are carried out successively with consistency. Thus, a metal belt coated with lubricative resin can be manufactured at low cost. It has been confirmed that the metal belt thus formed is several times longer in service life than the one of polyimide, and its service life is equal to that of an ordinary heat roller.

Owing to the metal belt 4 and the stainless steel thin plate structure of the heating and cooling unit 411, the highest temperature of the PTC thermistor heater 41 is higher only 20° to 30° C. than a temperature required for fixing the toner 7, and accordingly the highest temperature of the unit 411 can be greatly reduced. This means that, even if a fixing sheet is abnormally heated being caught in the device for instance, no other trouble is caused. In addition, the inherent safety of the PTC thermistor heater 41 of self control type guarantees the considerably high safety of the thermal fixing device of the invention.

In order to allow the metal belt 4 to slide on the heating and cooling unit 411, as was illustrated in the above-described embodiment it is necessary to subject the inner surface of the metal belt 4 or the outer surface of the thin stainless steel plate 45 to lubrication treatment.

In addition, it is preferable that the heating and cooling unit 411 is larger in curvature on the image support inlet side than on the image support outlet side.

Similarly as in the above-described embodiment, the thermal fixing device starts quickly, and has an envelope fixing function.

In the thermal fixing device according to the first aspect of the invention, the temperature of the heating source in the heat roller is decreased so that the thermal efficiency is improved, and the temperature rise time is greatly reduced so that the device is started quickly. Furthermore, the thermal fixing device of the invention is high in durability, and is employable as those ranged from low speed ones to high speed ones. In the case of the low speed thermal fixing device, it is unnecessary to provide the temperature sensor and the temperature controlling power source for the heat roller, and no offset is caused even when a transfer sheet different in size is used.

Furthermore, the thermal fixing device according to the second aspect of the invention has the following merits or effects, and can be realized as a middle or high speed thermal fixing device which is long in service life. That is, it can start quickly without being preheated, it can fix sheets different in size, and it has the envelope fixing function. In the device, the temperature control can be achieved with ease, and no offset is caused, and the power consumption is low. Furthermore, it is unnecessary to employ the separating pawl or the oil pad; that is, the number of components is greatly reduced. Hence, an electrophotographing apparatus can be realized according to the invention which is small in size and low in power consumption.

The thermal fixing device according to the third aspect of the invention has the following merits and effects: It can be started without being preheated, and is long in service life, dispensing with maintenance. Furthermore, it is low in power consumption and high in safety, and can fix sheets different in size and has the envelope fixing function. In addition, no offset occurs with all kinds of toner. Moreover, it is unnecessary for the device to employ the temperature sensor, the temperature controlling power source, the microcomputer control means, the separating pawl, the oil pad, etc. Thus, in the device, the number of components is greatly reduced. The device can be miniaturized, and formed in low manufacturing cost., While the invention has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A thermal fixing device having at least two rollers, a heat generating unit, a cooling unit, and a belt supported in tension by at least one of said at least two rollers, said heat generating unit and said cooling unit, wherein an image support having an unfixed toner image is passed between an outer circumferential surface of said belt, and another of said at least two rollers so that said toner image is fixed by thermal melting, wherein:

said heat generating unit and said cooling unit are partially embedded within a heat insulating support, and wherein said belt comprises;

an annular metal film having a layer of lubricative resin formed on an outer circumferential surface thereof.

2. A thermal fixing device as recited in claim 1, wherein said heat generating unit is partially embedded within said heat insulating support so as to be adjacent an image support inlet side, and said cooling unit is partially embedded within said heat insulating support so as to be adjacent an image support outlet side.

3. A thermal fixing device as recited in claim 1, wherein said heat generating unit and said cooling unit are partially embedded within said heat insulating support so as to be adjacent to each other.

4. A thermal fixing device comprising at least two rollers, a heat generating unit, a cooling unit, and a belt supported in tension by at least one of said at least two rollers, said heat generating unit and said cooling unit, wherein an image support having an unfixed toner image is passed between an outer circumferential surface of said belt, and another of said at least two rollers so that said toner image is fixed by thermal melting, wherein:

said heat generating unit is partially embedded within said cooling unit said heat generating unit comprising a PTC thermistor heater element as a heat source, and wherein said metal belt comprises an annular metal film having a layer of lubricative resin formed on an outer circumferential surface thereof.

5. A thermal fixing device as recited in claim 4, wherein said cooling unit is made of a material high in thermal conduction and and includes a radiating section.

6. A thermal fixing device as recited in claim 4, wherein said cooling unit is U-shaped in cross section.

7. A thermal fixing device as recited in claim 4, wherein said radiating section includes radiating fins.

* * * * *